United States Patent [19]

Stanley et al.

[11] 4,357,187

[45] Nov. 2, 1982

[54] WINDOW OVERLAY FOR THERMAL INSULATION

[76] Inventors: Glenn Stanley; Michael Stanley, both of 3339 Amherst La., San Jose, Calif. 95117

[21] Appl. No.: 179,069

[22] Filed: Aug. 18, 1980

[51] Int. Cl.[3] ..... E06B 3/64

[52] U.S. Cl. ..... 156/107; 156/71; 156/109; 52/203; 52/788; 428/34

[58] Field of Search ..... 156/71, 107, 109; 428/34; 52/202, 398, 788, 790, 172, 203; 49/61, 475

[56] References Cited

U.S. PATENT DOCUMENTS

| | | | |
|---|---|---|---|
| 2,177,001 | 10/1939 | Owen | 52/398 |
| 3,940,898 | 3/1976 | Kaufman | 428/34 |
| 3,971,178 | 7/1976 | Mazzoni et al. | 52/202 |

FOREIGN PATENT DOCUMENTS

| | | | |
|---|---|---|---|
| 2824896 | 12/1979 | Fed. Rep. of Germany | 52/203 |
| 2288846 | 5/1976 | France | 52/203 |
| 2400607 | 4/1979 | France | 52/202 |

*Primary Examiner*—Edward C. Kimlin
*Assistant Examiner*—F. K. Wine
*Attorney, Agent, or Firm*—David A. Boone; Jon R. Stark

[57] ABSTRACT

A border molding strip is placed about the perimeter of an existing window pane. A second pane is then placed upon this border material. A retaining border is then placed to retain the window pane firmly against the border material, thus creating an airtight seal between the existing window pane, the border material and the second window pane. Appropriate adhesive and sealing compounds are applied to insure an airtight seal. Thereafter, the space between the existing window pane and the supplemental pane is purged with dry gas and may be evacuated through an opening exposed under a portion of the retaining means. After the window pane is purged and evacuated, a plug is inserted and the opening in the molding material is closed.

2 Claims, 9 Drawing Figures

WINDOW OVERLAY FOR THERMAL INSULATION

BACKGROUND AND SUMMARY OF THE INVENTION

Increasing energy costs have created demand for double pane and other insulating windows to cut down on heat loss through the windows. Energy conservation homes of new construction are utilizing these windows to significantly reduce home heating costs.

However, these double pane windows now available for new construction are a costly and inconvenient solution to the problem in homes with existing single pane windows. Until this time the homeowner has been faced with the costly removal and discarding of the window structures of his home and the replacement of them with expensive double pane window assemblies of new construction. Other alternatives have involved the use of blinds or drapes to provide an additional insulating layer. These alternative methods are particularly unsatisfactory for those windows where it is desired to maintain the ability to see through the window. In accordance with the preferred embodiment of the present invention, a border molding strip is placed about the perimeter of an existing window pane. A second pane is then placed upon this border material. A retaining border is then placed to retain the window pane firmly against the border material, thus creating an airtight seal between the existing window pane, the border material and the second window pane. Appropriate adhesive and sealing compounds are applied to insure an airtight seal. Thereafter, the space between the existing window pane and the supplemental pane is purged with dry gas and may be evacuated through an opening exposed under a portion of the retaining means. After the window pane is purged and evacuated, a plug is inserted and the opening in the molding material is closed.

DESCRIPTION OF THE PREFERRED EMBODIMENT

Figure 1:
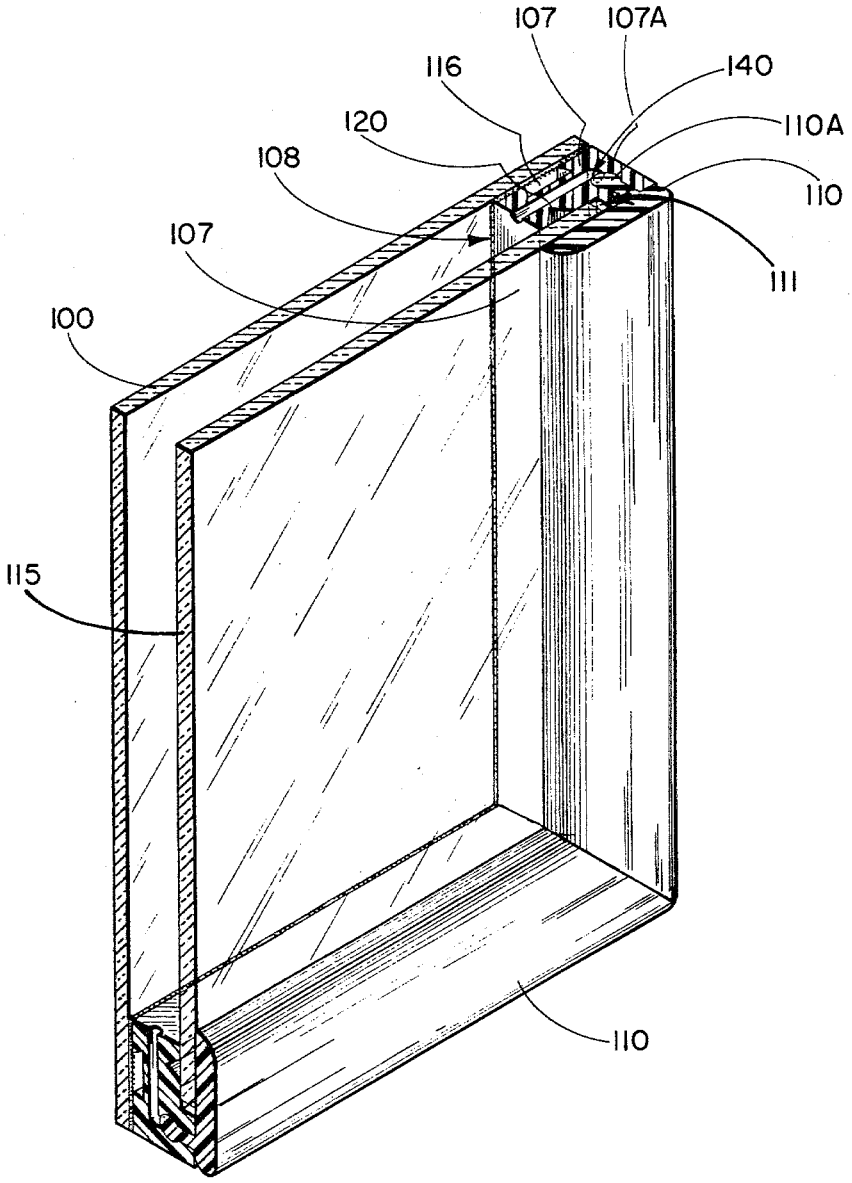
FIG. 1 is a perspective cutaway view showing the edge portion of a window assembly in accordance with the preferred embodiment.

Referring now to FIG. 1 there is shown a window pane 100 which will typically be in place in an existing window structure. For purposes of this illustration, the existing window frame structure is not shown in the drawing. Also shown in the drawing is border molding 107 which is affixed to window pane 100 along the mating surface 108 therebetween. A suitable adhesive to join the two materials is used to provide an airtight and long-lasting seal. Pressure sensitive tape may also be used.

The pane of window material 115 being added is placed in position on border material 107. Additional adhesive or sealing compounds may be placed in optional channel 120 of border material 107. Retainer molding 110 is placed in position after pane 115 is firmly seated on border molding 107. Retainer molding 110 is held in place by the force fitting of bulbous ridge 110A which runs the length of molding 110 into a similarly but smaller shaped channel opening 107A in border molding 107.

Figure 2C:
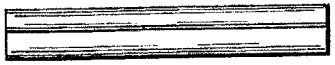
FIG. 2B is a top view and FIG. 2C is a side view of the retainer molding of the preferred embodiment.
Figure 3C:
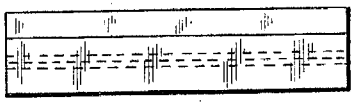
FIG. 3B is a bottom view and FIG. 3C is a side view of the border molding used in the preferred embodiment.
Figure 2B:
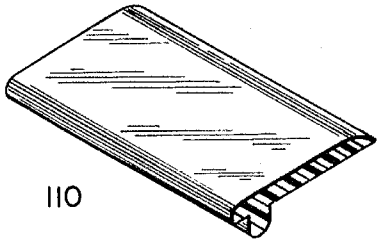
Figure 3B:
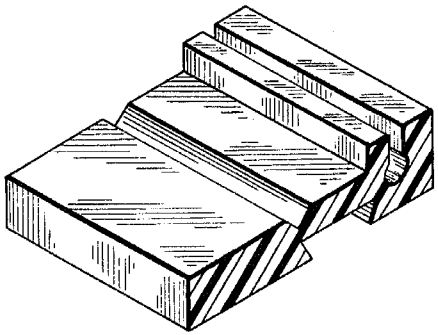
Figure 2A:
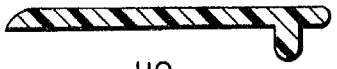
FIG. 2A is an end view.
Figure 3A:
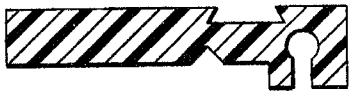
FIG. 3A is an end view.

FIGS. 2A, 2B and 2C, show an end view, a top view and a side view respectively of the retainer molding 110 of the preferred embodiment. FIGS. 3A, 3B and 3C shown an end view, a bottom view and a side view of the border molding 107 used in the preferred embodiment. Both FIG. 2 and FIG. 3 show an arbitrary length of border material. The exact length used for any particular application is determined by measuring the window and cutting the molding to size. The corners are formed by 45° miter cuts at the corner positions as illustrated in FIG. 1. These corner cuts should be accurately made and additional adhesive or sealant such as silicone rubber compound No. 2567-012 available from Dow Corning applied liberally to ensure an airtight seal between the existing window glass and the additional pane of window material being added.

A sealing edge is provided at the mating surface 108 between window glass 100 and border molding 107 by using an adhesive or pressure sensitive tape.

Retainer molding 110 and border molding 107 may be made of any suitable material. However, the best material has been found to be a plastic rubber material which retains some pliability over time. In the preferred embodiment the moldings are constructed of a vinyl plastic material. Pressure sensitive tape or adhesive is applied around the edge of the existing window pane 100. Border molding 107 is then put in place using the aforementioned pressure sensitive tape or adhesive. The silicone compound is then placed into the v-shaped channels 120 and channel 116, if they are provided. These channels 120 and 116 ensure an airtight seal and better adhesion. These channels are shown in more detail in FIGS. 4 and 5. The pane of window material being added is then put into position. Retainer molding 110 is snapped into place into border molding 107. Note that is is particularly important that the miter corners in border molding 107 be as accurate as possible and that the additional silicone sealant effectively fill any gaps which occur if the space between the panes is to be evacuated. Note that while it is important for the mitering of the retainer molding 110 to be as carefully done as possible for appearance sake, the top molding is not as important in maintaining the airtight seal between panes 100 and 115.

The next step in completing the installation of the preferred embodiment is to purge the air space between panes 100 and 115 with some dry gas such as nitrogen. This is accomplished in the preferred embodiment by providing at least two vent holes in the molding such as vent hole 140. Purging is accomplished by leaving one vent hole open and providing the drying nitrogen through the other. Preferably the vent holes provided should be at opposite diagonal corners. After purging is completed, the vent holes such as vent hole 140 are plugged with a silicone compound or a rubber stopper in area 141. Additionally, a hollow needle and a vacuum pump may then be used to draw a predetermined vacuum through a rubber stopper in one of the vent holes. When the needle is removed the rubber stopper reseals itself substantially retaining the vacuum in the space between panes 100 and 115. This vacuum provides increased insulating effectiveness.

Figure 4:
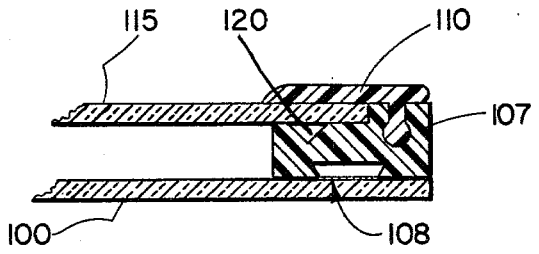
FIG. 4 is an end view showing a sectional view of the completed composite structure of the preferred embodiment.
Figure 5:
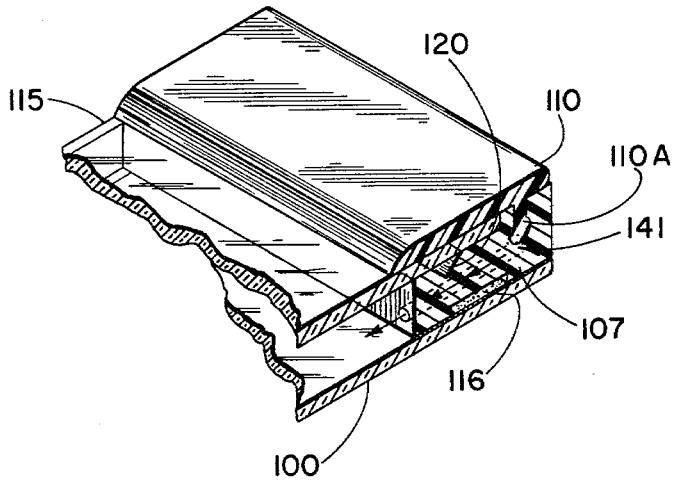
FIG. 5 is an end perspective view which shows the construction of the vent holes in the molding of the preferred embodiment.

FIG. 4 is an end view of an installation in accordance with the preferred embodiment. This view clearly shows the mating of the border molding with the retaining molding. In the preferred embodiment the gap between the panes 100 and 115 is approximately 5/16 of an inch. The retainer molding being approximately 13/16 of an inch and slightly larger than the border molding which is ¾ of an inch. FIG. 5 is an end perspective view which more clearly illustrates the construction of the vent holes used for purging the area between the window panes. Channels 116 and 120 are filled with the aforementioned silicone rubber compound.

I claim:

1. A method of converting an existing single pane window to a double pane evacuated window installation, said method comprising the steps of:

applying one surface of a border molding to an existing window pane using an adhesive sealant applying additional sealant to an opposite surface of said border molding;

placing a second pane of preselected window material in contact with said additional sealant on said opposite surface of said border molding;

applying a retainer molding which interlocks with said border molding to retain said second pane thereby forming an airtight cavity between said window panes; and evacuating the space between said existing window pane and said second pane of window material to form a preselected state of vacuum therebetween.

2. The method as in claim 1 and further comprising the step of purging the air space between the existing window pane and the pane of preselected window material with a dry gas prior to evacuating the space.

* * * * *